United States Patent [19]

Manchester et al.

[11] 4,022,396

[45] May 10, 1977

[54] INTERCONNECTED STACKED COILS FOR CONTINUOUS FEED

[75] Inventors: Edward A. Manchester; Bernard F. Talty, both of Mattapoisett, Mass.; Earle A. Hallstrom, Barrington, R.I.

[73] Assignee: Teledyne, Inc., Los Angeles, Calif.

[22] Filed: Oct. 31, 1975

[21] Appl. No.: 627,764

[52] U.S. Cl. ..... 242/55.17; 242/129

[51] Int. Cl.[2] ..... B65H 17/48

[58] Field of Search ..... 242/55.16, 55.17, 55.18, 242/55.19 R, 55, 129; 226/118; 57/141, 158

[56] References Cited

UNITED STATES PATENTS

| | | | |
|---|---|---|---|
| 3,089,588 | 5/1963 | Correll | 242/129 |
| 3,379,386 | 4/1968 | Bobolts et al. | 242/55 |

FOREIGN PATENTS OR APPLICATIONS

| | | | |
|---|---|---|---|
| 13,509 | 2/1965 | Japan | 242/55.19 R |

*Primary Examiner*—Leonard D. Christian
*Attorney, Agent, or Firm*—Shoemaker and Mattare, Ltd.

[57] ABSTRACT

A plurality of coils of flat strip material are connected with one another for continuous, uninterrupted uncoiling or feed of the material from the plurality of coils during a manufacturing process or the like. The coils are free of abrupt distortions and folds and the like at the interconnection portion of the material between adjacent coils, and the individual coils of the plurality of coils need not have binding straps and the like thereon.

9 Claims, 9 Drawing Figures

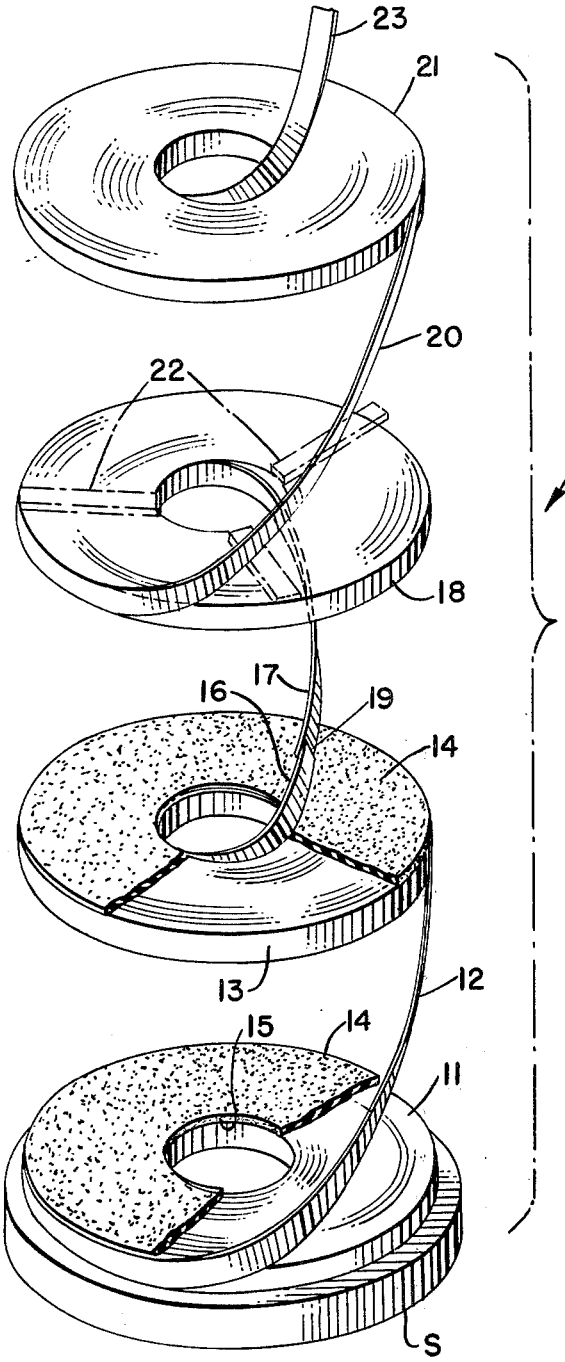
FIG. 1.
FIG. 4.
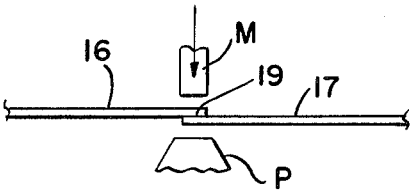
FIG. 5.
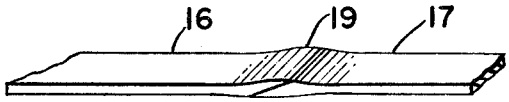
FIG. 3.
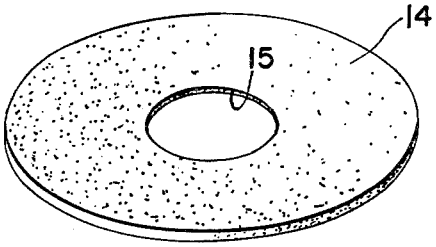
FIG. 2.
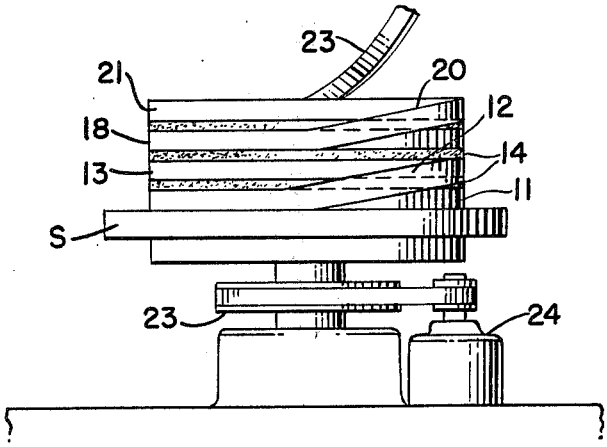

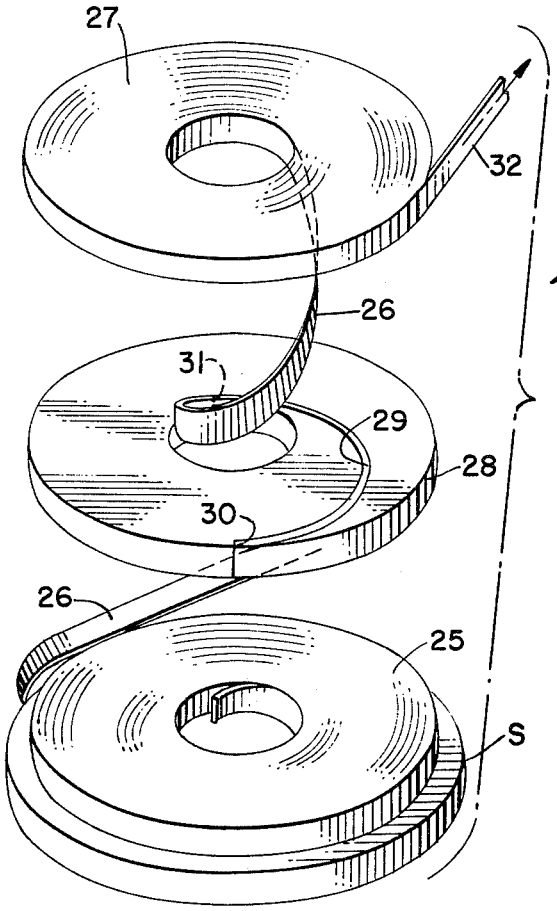
FIG. 6.
FIG. 7.
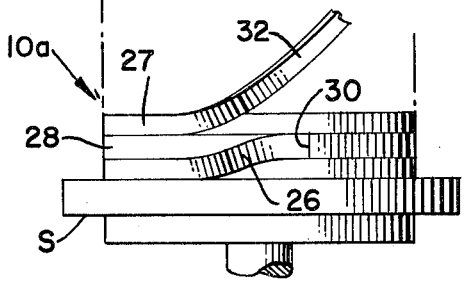
FIG. 9.
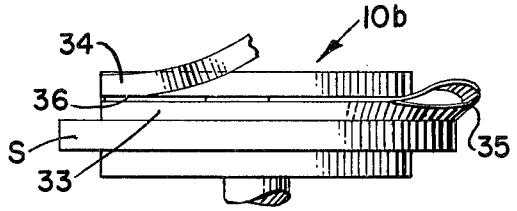
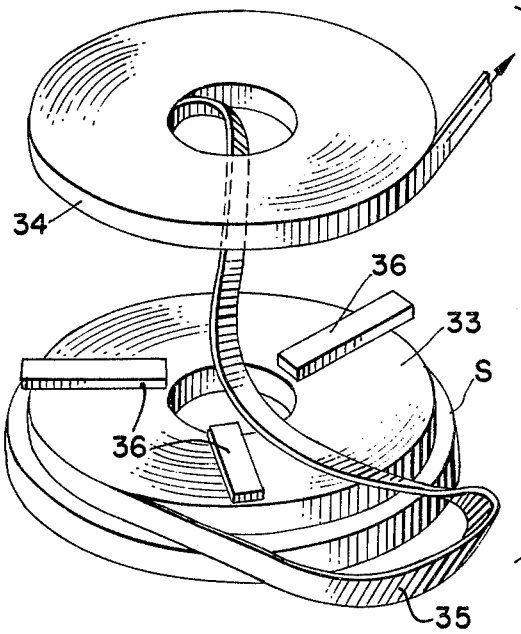
FIG. 8.
10b

INTERCONNECTED STACKED COILS FOR CONTINUOUS FEED

BACKGROUND OF THE INVENTION

This invention relates to an arrangement of stock material, such as flat strip material arranged in coils, which is fed or uncoiled from the coils for a desired use application. In particular, the invention relates to flat strip metal arranged in coils for continuous feed of the material to a machine involved in a stamping process or a spring machine or other equipment requiring continuous supply of material for extended periods of time.

Still more particularly, the present invention relates to an arrangement wherein a plurality of large diameter flat coils of flat strip metal are stacked in substantially coaxial relationship and interconnected one with the other for continuous and uninterrupted feed of the flat strip material from the coils during a manufacturing process.

In accordance with one form of the invention, a plurality of coils are substantially coaxially arranged, with alternate coils wound in opposite directions and with the outside of a first coil connected to the outside of a second coil, and the inside of the second coil connected to the inside of a third coil, and so on throughout a plurality of coils containing any desired number of coils.

In another form of the invention, a plurality of coaxially arranged flat coils of strip material are arranged with the outside of a first coil wound into the inside of a second coil, and with the transition from the outside of the first coil to the inside of the second coil passing through a spacer positioned between the coils.

In a third form of the invention, a plurality of flat coils of strip material are arranged with the outside of a first coil wound into the inside of a second coil, and with the strip of material extending from the outside of the first coil to the inside of the second coil lying flat against the first coil and sandwiched between the first and second coils.

In many manufacturing processes, such as in spring machines or stamping processes and the like, a relatively continuous supply of strip material is required for extended periods of time. In the prior art, flat coils of stock are provided for supplying the material to such machines and the like, and since the maximum diameter of the coils is limited due to space requirements and ease of handling and the like, the length of time which the stock can be continuously fed to the machines is accordingly limited. Thus, with prior art apparatus, each time a single coil is depleted, the machine must be shut down and another coil supported on a payoff or payout stand and the strip of material threaded to the machine. This requires a downtime of the machine of about 10%, with resultant loss in production and increased costs to the manufacturer and thus the consumer. One attempt in the prior art to solve the above problems involved the provision of a transverse wound coil comprised of a strip of material wound upon a spool in the manner of line wound upon a fishing reel, whereby a continuous supply of material equal to several of the usual flat coils could be provided for continuous feed to a machine. While this arrangement is satisfactory for some materials, such as rods or string or wire or the like, it has not proven satisfactory for use with flat strip materials, since the material tends to become caught or overlapped, thus stopping feed of the material and interrupting production.

With the present invention, however, a plurality of coils can be formed from a continuous strip of material, wound continuously from one coil to the next, or if desired, separate coils can be quickly and easily manufactured in a conventional manner with existing equipment and the ends of adjacent coils spliced together. In either event, the coils can then be stacked one upon the other for continuous feed from the coils in successive order without requiring downtime of the machine for rethreading of a new supply of stock, as is required in the prior art. Also, with the unique interconnection of the plurality of stacked coils according to the invention, the problem of jamming or interruption of feed of the stock from the coils is eliminated. Moreover, whereas with conventional single flat coils the amount of material which may be continuously supplied to the machine is limited due to the maximum diameter of the coils, and whereas in traverse wound coils the maximum thickness of the coils is limited due to practical considerations, in accordance with the present invention as many coils may be stacked one upon the other as desired for continuous feed for a desired period of time. Further, with coils connected according to the invention, binding straps on the coils can be eliminated, and in fact the coils need not be confined for proper operation. Still further, coils wound according to the invention are less costly and more simple to make than prior art arrangements, and are lighter in weight. Additionally, in some forms of the invention, including the preferred form, there is no distortion of stock going from one coil to another, and in the preferred form, spacers are not required between adjacent coils. Also, any welds or splices between lengths of the strip material can be appropriately marked for easy identification and removal after processing.

OBJECTS OF THE INVENTION

Accordingly, it is an object of this invention to provide a plurality of flat coils of strip material stacked one upon the other and interconnected for continuous and uninterrupted feed of the material from the coils to a machine during a manufacturing process or the like.

Another object of the invention is to provide a plurality of coils of flat strip material which are connected in a manner to prevent catching or binding of the material as it is continuously uncoiled from the stacked coils.

A still further object of the invention is to provide a plurality of interconnected coils of flat strip material which are arranged to be continuously fed to a machine in a manufacturing process or the like such that the downtime of the machine is reduced.

An even further object of the invention is to provide a plurality of coils of continuously wound material which are interconnected for continuous feed, and wherein the individual coils are free of binding straps and the like.

BRIEF DESCRIPTION OF THE DRAWINGS

FIG. 1 is an exploded, perspective view of a first and preferred embodiment of the invention, showing the manner in which a plurality of coils are interconnected with one another.

FIG. 2 is a view in elevation of a reduced scale showing a plurality of coils supported on a payoff stand, with the coils interconnected in accordance with the form of the invention shown in FIG. 1.

FIG. 3 is a perspective view of one of the friction members which may be provided between the coils in FIG. 1 to prevent lateral slipping between adjacent coils during handling and use.

FIG. 4 is a schematic view illustrating one manner in which the ends of adjacent coils may be spliced or connected together.

FIG. 5 is a fragmentary, perspective view of a spliced joint between ends of the flat strip material of adjacent coils.

FIG. 6 is an exploded, perspective view similar to FIG. 1 of a second form of the invention.

FIG. 7 is a side view in elevation similar to FIG. 2, showing the coils of FIG. 4 stacked in operative position on a payoff stand.

FIG. 8 is an exploded, perspective view similar to FIGS. 1 and 4 of a third form of the invention.

FIG. 9 is a view similar to FIGS. 2 and 7 of the coils of FIG. 8 supported in operative position on a payoff stand.

DETAILED DESCRIPTION OF THE PREFERRED EMBODIMENTS

In the drawings, wherein like reference numerals indicate like parts throughout the several views, a first and preferred arrangement of coils is indicated generally at 10 in FIG. 1 and comprises a first coil 11 of flat strip material wound in a counterclockwise direction and joined at an interconnecting portion 12 at the outer edge thereof to an adjacent outer edge of an identical but oppositely wound flat strip of material wound into a second coil 13.

A separating means, such as a thin sheet 14 of friction material, such as rubber or paper or the like, and having a configuration in plan view like that of the coils, if desired, with a hole 15 in the center thereof, is placed or sandwiched between adjacent coils to prevent lateral slippage therebetween.

The inner end 16 of the second coil 13 is connected to the inner end 17 of a third coil 18 of identical flat strip material, and the third coil is wound identically to the first coil, or, in other words, in a counterclockwise direction. As indicated, the coils 13 and 18 could be manufactured separate and then joined as by a weld at 19.

The outer end of the third coil 18 is connected by an interconnecting portion 20 to the outer end of a fourth coil 21 of identical flat strip material, wound identically to the second coil 13, or, in other words, in a clockwise direction. The inner end of the fourth coil 21 extends either to a subsequent coil (not shown) or to a suitable machine for use or processing of the strip material, as desired.

Rather than the sheet 14 of antifriction material, the separating means can include strips 22, as indicated in dot and dash lines between coils 18 and 21.

As can be readily seen, the outer end of the coil 11 is connected with the outer end of the next adjacent coil 13, with the coils 11 and 13 being wound in opposite directions. The inner end of coil 13 is, in turn, connected to the inner end of the next adjacent coil 18, with the coils 13 and 18 also being wound in opposite directions. The outer end of coil 18 is then connected with the outer end of the next adjacent coil 21, with the coils 18 and 21 also being wound in opposite directions.

Any number of coils may be interconnected and stacked one upon the other in successive fashion, as illustrated by the four coils in FIG. 1, and the thus interconnected stacked coils are supported on a suitable payoff stand S, desirably provided with means such as pulley 23 and motor 24 for positively rotating the payoff stand in synchronization with the machine to which the stock is being supplied to prevent twist of the stock as it is paid off or unwound from the coils.

FIGS. 4 and 5 are enlarged, schematic views of one form of joint or splice which may be provided between adjacent ends of the strip of material if the strip is not continuously wound, and as seen in FIG. 4, the ends are slightly overlapped at splice 19 and a mandrel M is then brought down against the splice, which is supported on a platen P, and heat is applied concommitantly with pressure, whereby a secure weldment of the adjacent ends is obtained and the thickness of the splice is maintained at a minimum. As an example, if the strip of material has a thickness of 0.010 inch, then, for at least some applications, the joint or splice 19 should have a thickness of less than 0.020 inch.

A second form of invention is illustrated at **10*a* in FIGS. 6 and 7, and in this form of the invention a first coil 25 is continuously coiled or wound via an interconnecting portion 26, with the inner end of an identically wound strip of material in a second coil 27. The coils 25 and 27 are wound in the same direction, and a spacer disc 28 is interposed between the coils 25 and 27. The spacer disc 28 has an axial thickness at least as great as the thickness of the coils 25 and 27, or, in other words, the spacer disc is at least as wide as the width of the strip of material comprising the coils 25 and 27. An arcuately shaped slot 29 is formed in the spacer disc 28 and has an outer end 30 which extends substantially tangential to the outer surface of spacer disc 28 and inner end 31, which extends substantially tangential to the inner peripheral surface of the spacer disc 28. The interconnected portion 26 of the strip material extending between the outer end of coil 25 and the inner end of coil 27 extends through the arcuate slot 29 from the outer end 30 to the inner end 31 thereof, and thus when the coils are stacked together as in FIG. 7, the spacer disc prevents crushing of the interconnection portion of the strip of material and guides the strip of material as it is unwound from the coils. The outer end 32 of coil 27** may be extended through a subsequent spacer disc (not shown) for connection to subsequent coils, or it may be supplied to a machine or the like, as desired.

In FIGS. 8 and 9, a third form of the invention is indicated generally at **10*b* and comprises a first coil 33 of flat strip material having the outer end thereof connected to the adjacent inner end of a superadjacent coil 34, via an interconnecting portion 35, with the coils 33 and 34 both being wound in the same direction. Suitable spacers 36 are provided between the coils 33 and 34**, and the stacked coils are supported on a payoff stand S for supply of the strip material to a machine or the like.

Further, in order to prevent crushing of the interconnecting portion 35 of the strip of material, it is turned 90 degrees and lies flat against the bottom coil, extending generally radially thereacross, as indicated best in FIG. 8.

Thus, in all three forms of the invention the strip of flat material is provided in a series of interconnected coils for substantially continuous, uninterrupted supply of the strip of material to a machine or the like for use in a manufacturing process, whereby the downtime of the machine is significantly reduced. The strip may be continuously wound from a single strip or spliced, as desired.

A typical strip material wound and interconnected in accordance with the invention comprises steel, and strips ranging in thickness from 0.005 inch to 0.010 inch and widths from 0.250 inch to 1.000 inch are typically encountered.

Further, in use the coils are prevented from lateral or rotational movement relative to one another while the material is being handled and/or uncoiled.

Moreover, the coils may be arranged with their axes horizontal rather than vertical, as illustrated, or at any desired angle for that matter As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A plurality of interconnected coils of flat strip material for substantially uninterrupted, multicoil supply of the material for an extended period of time to a use application such as a machine during a manufacturing process and the like, said coils comprising a first coil of the material connected serially to an adjacent coil by an interconnecting portion of the material extending from one coil to the other, the interconnecting portion of the coils being arranged so that the strip of material may be continuously unwound from one coil to the next for uninterrupted supply to a machine and the like, individual coils of said plurality of coils being free of binding straps and like coil confining means, and separating means of flat friction material interposed between said coils with said coils both being in contact with said separating means so that said coils can be arranged in a stacked configuration with one coil on top of the other, said separating means defining a passage permitting said interconnecting portion to pass said separating means in a manner such that said strip material flows from one coil to the other without jamming or interrupting the flow thereof.

2. A plurality of interconnected coils as in claim 1, wherein said separating means comprises frictional means to prevent lateral and relative rotational movement between adjacent coils during handling thereof and during uncoiling of the material.

3. A plurality of interconnected coils as in claim 1, wherein first and second coils of flat strip material are arranged in coaxial relationship, the interconnecting portion of the material extending from an outer edge of the coil to an inner edge of the second coil, the first and second coils being wound in the same direction, and said separating means including a spacer member sandwiched between the first and second coils and having inner and outer peripheries and a diameter and thickness substantially the same as the diameter and thickness of each of the coils and having an arcuate slot therein extending from the outer periphery thereof to the inner periphery thereof, the interconnecting portion of the strip of material extending through and guided by said slot.

4. A plurality of interconnected coils as in claim 1, wherein said separating means includes a plurality of frictional spacer blocks sandwiched between the coils to prevent relative lateral and rotational movement therebetween.

5. A plurality of interconnected coils as in claim 2, wherein the frictional means comprises a plurality of strips of material.

6. A plurality of interconnected coils as in claim 2, wherein the frictional means comprises a sheet of material generally corresponding in plan view to the coils.

7. A plurality of interconnected coils as in claim 1, wherein the strip material comprises metal.

8. A plurality of interconnected coils as in claim 1, wherein the interconnecting portion of the material is spliced together by a weld.

9. A plurality of interconnected coils of flat strip material for substantially uninterrupted, multicoil supply of the material for an extended period of time to a use application such as a machine during a manufacturing process and the like, said coils comprising a first coil of the material serially connected to an adjacent coil by an interconnecting portion of the material extending from one coil to the other, the coils being coaxially arranged and wound in the same direction, the interconnecting portion of the coils being free of abrupt distortions and folds and the like and extending from the outer edge of the first coil to the inner edge of the second coil, and the interconnecting portion of the strip of material gradually and smoothly turned 90 ° to the plane of the strip wound in the coils and disposed in flat engagement with the side of the first coil and sandwiched between the coils so that the strip of material may be continuously unwound from one coil to the next for uninterrupted supply to a machine and the like, individual coils of said plurality of coils being free of binding straps and the like coil confining means.

* * * * *